United States Patent [19]

Liautaud

[11] 4,170,777

[45] Oct. 9, 1979

[54] MOBILE ANTENNA

[75] Inventor: James P. Liautaud, Cary, Ill.

[73] Assignee: American Antenna Corporation, Elgin, Ill.

[21] Appl. No.: 860,236

[22] Filed: Dec. 13, 1977

[51] Int. Cl.[2] ..... H01Q 1/32; H01Q 9/00; H01Q 1/50; H01Q 9/30

[52] U.S. Cl. ..... 343/715; 343/713; 343/749; 343/850; 343/900

[58] Field of Search ..... 343/715, 713, 749, 750, 343/745, 850, 900

[56] References Cited

U.S. PATENT DOCUMENTS

| | | | |
|---|---|---|---|
| 2,839,752 | 6/1958 | Webster | 343/745 |
| 2,894,260 | 7/1959 | Ellis | 343/745 |
| 4,058,811 | 11/1977 | Gauss et al. | 343/715 |
| 4,063,206 | 12/1977 | Walker | 343/750 |

*Primary Examiner*—Alfred E. Smith
*Assistant Examiner*—Harry E. Barlow
*Attorney, Agent, or Firm*—Lockwood, Dewey, Alex & Cummings

[57] ABSTRACT

A mobile antenna includes a radiating element and an inductance winding for tuning the radiating element for operation on a desired frequency. The inductance winding is supported within the base of the antenna by a core assembly and an overmold layer within which the turns of the winding are partially embedded. The winding is preferably formed with a relatively large diameter and of relatively heavy gauge wire, and the winding support core is preferably formed with a chamber concentric to the winding to improve the electrical efficiency of the winding, and hence the radiating efficiency of the antenna.

10 Claims, 8 Drawing Figures

2.

FIG. 4
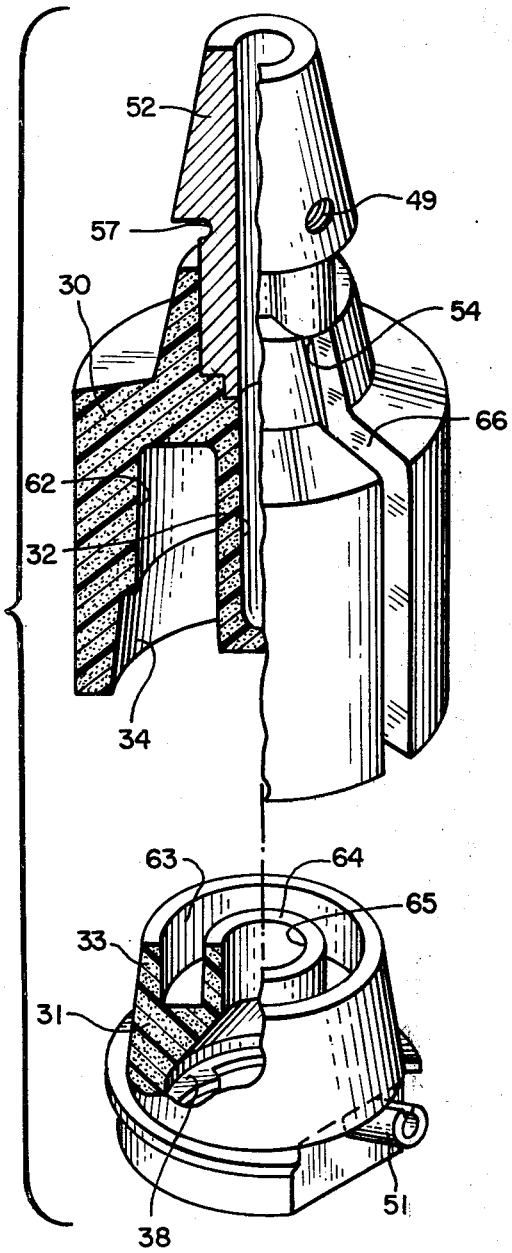
FIG. 5
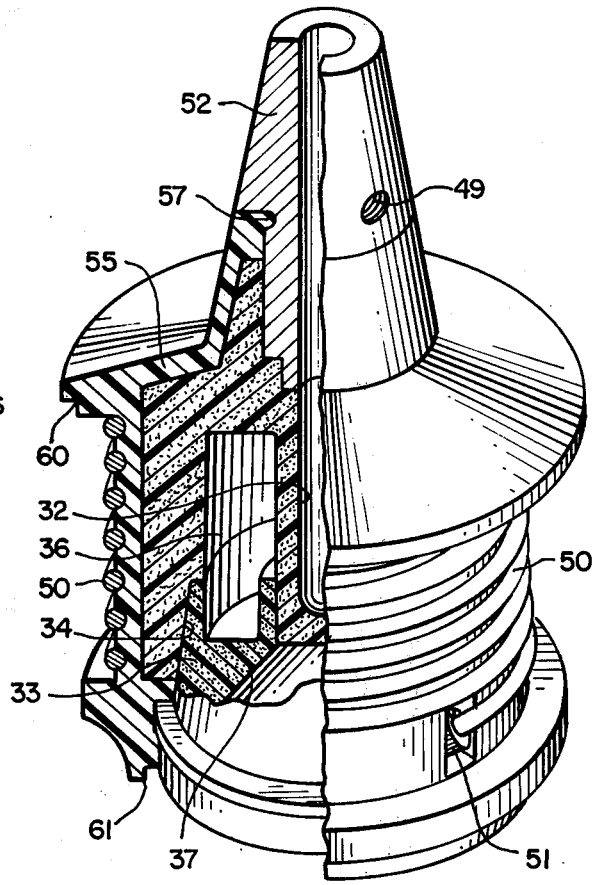
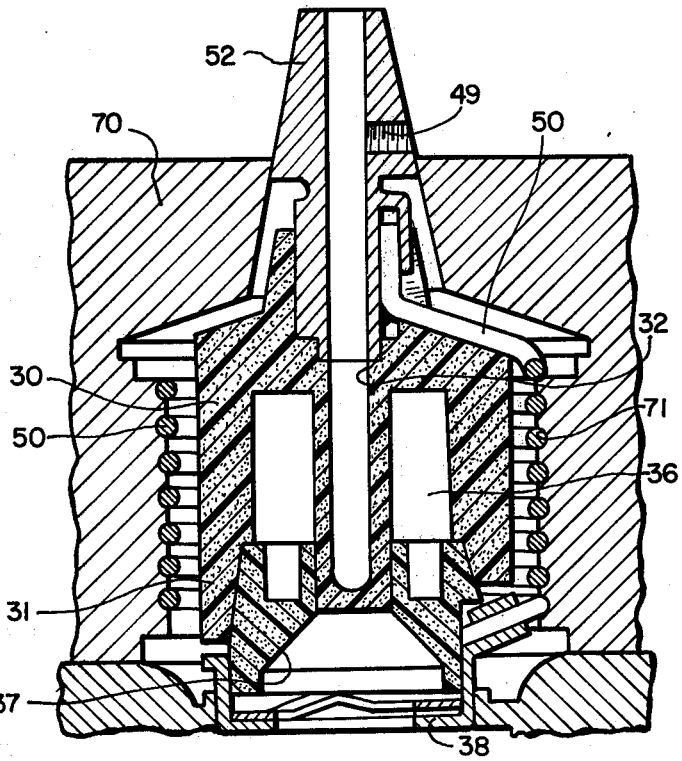
FIG. 6

MOBILE ANTENNA

BACKGROUND OF THE INVENTION

The present invention relates generally to mobile antennas, and more particularly to an improved mobile antenna which is more economical to construct and which provides improved operating efficiency.

In recent years the increased use of personal mobile communications equipment, particularly that intended for use on the Citizen Band, has created the need for mobile antennas suitable for mounting on the exterior surfaces of automobiles and other vehicles. Preferably, because of the relatively low power levels involved, such antennas should provide the highest possible operating efficiency. Furthermore, such antennas should not be unnecessarily expensive, preferably lending themselves to fabrication using economical injection-molding techniques.

Prior art mobile antennas for Citizen Band applications having not completely satisfied these objectives. In particular, such antennas have typically incorporated a solid one-piece core of relatively small diameter for supporting the loading coil of the antenna, resulting in undesirably low operating efficiency for the antenna. Furthermore, such prior art designs required that the radiating element of the antenna be cut to length to tune the loading coil, thereby making it unnecessarily difficult for the user to fine tune the coil once installed and preventing retuning of the antenna in a subsequent installation requiring a longer radiating element.

The mobile antenna of the present invention, preferred constructions and mounting arrangements of which are further described in the co-pending applications of James P. Liautaud entitled "Mobile Antenna With Adjustable Radiating Element", Ser. No. 860,245; "Mobile Antenna Including Quick-Release Mounting", Ser. No. 860,247; "Mobile Antenna Mounting Assembly", Ser. No. 860,237; and "Antenna Mounting Adaptor", Ser. No. 860,234, filed concurrently herewith, overcomes the drawbacks of prior art mobile antenna designs in a form which is economical to manufacture and which is adapted to efficient operation in a wide variety of mounting situations.

SUMMARY OF THE INVENTION

The invention is directed to a mobile antenna of the type including an elongated radiating element and an inductance winding electrically connected to the radiating element for tuning the element to a desired frequency. The inductance winding is supported within the antenna base by means of a winding support core and an overmold layer in which the winding is at least partially embedded. The core is preferably formed of two interlocking sections which form therebetween a hollow chamber to improve the electrical efficiency of the winding, and hence the radiating efficiency of the antenna.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 4 is an enlarged exploded perspective view showing the loading coil support core sections and associated end fitting of the mobile antenna.

FIG. 5 is an enlarged perspective view of the loading coil, loading coil core, overmold support layer and associated end fitting of the mobile antenna in an assembled state.

FIG. 6 is a cross-sectional view showing the loading coil core, loading coil and associated end fitting positioned within a mold during manufacture prior to injection of the overmold support layer.

DESCRIPTION OF THE PREFERRED EMBODIMENT

Figure 1:
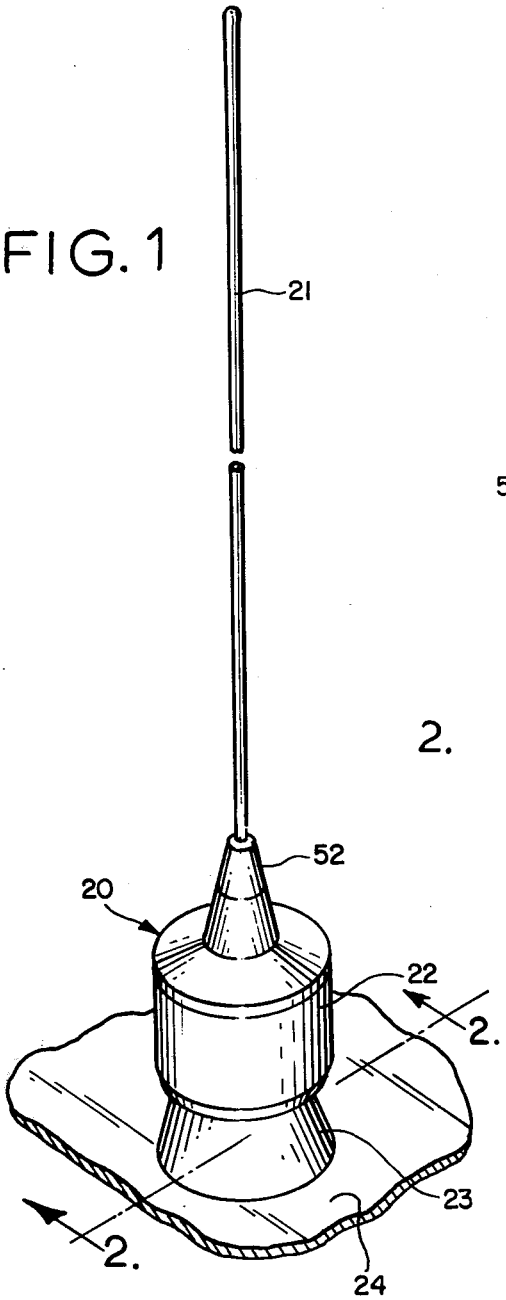
FIG. 1 is a perspective view of a mobile antenna constructed in accordance with the present invention.

Referring to the Figures, and particularly to FIG. 1, a mobile antenna 20 constructed in accordance with the invention includes a vertical radiating element 21 preferably formed of spring wire or other flexible electrically-conductive material. The radiating element 21 extends from a base portion 22 for a predetermined length dependent on the operating frequency of the antenna. The base portion 22 is releasably mounted to a skirt member 23 which is in turn mounted to an underlying supporting surface 24, which may comprise the body panel of an automobile or other motor vehicle.

As an alternative to the flat mounting arrangement illustrated in FIG. 1, antenna 20 may be mounted to an inclined surface by means of the antenna mounting base described in the previously identified application Ser. No. 860,237, or may be mounted to the edge of a body panel or to a motor vehicle rain gutter by means of the mounting adaptor described in the previously identified application Ser. No. 860,234. In either of these applications, as well as in the flat mounting application illustrated, the mounting pin and socket arrangement described in the previously identified application Ser. No. 860,247 allows the base and radiating elements to be readily removed by the user when the antenna is not in use to discourage theft and vandalism.

Figure 2:
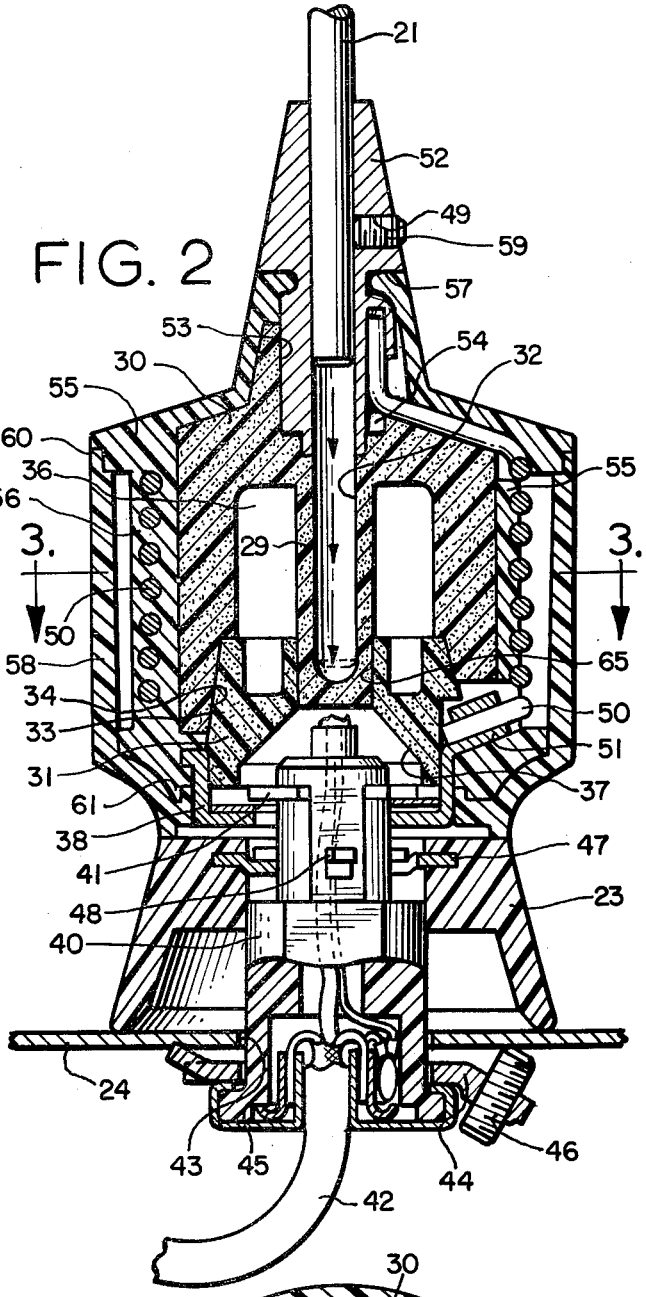
FIG. 2 is an enlarged cross-sectional view of the mobile antenna of FIG. 1 showing the loading coil, loading coil core and radiating elements of the antenna.
Figure 3:
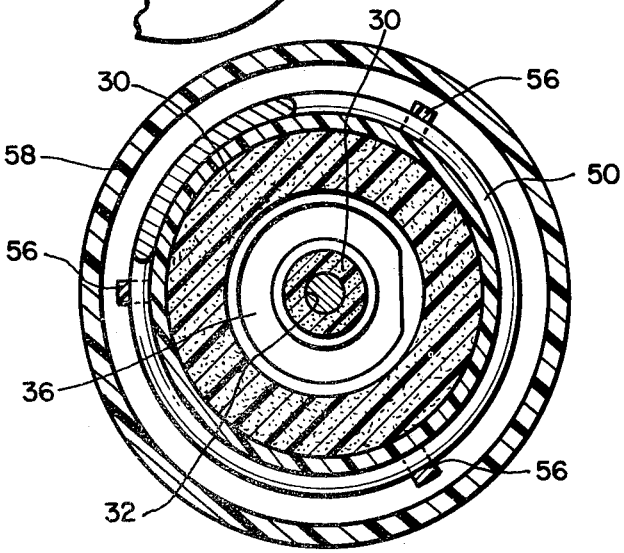
FIG. 3 is a cross-sectional view taken along line 3—3 of FIG. 2.

Referring to FIG. 2, the housing 22 of the mobile antenna is seen to include a two-piece core composed of interlocking upper and lower core sections 30 and 31. The upper core section 30, which is generally in the form of a hollow cylinder closed at one end, includes a central axially-aligned hub portion 29 extending along substantially its entire axis. An axially-aligned bore 32 extends through the end portion and along the central hub portion 29 to provide a recess within which the radiating element 21 can be slidably received, in a manner to be described presently.

The lower core section 31 is formed for telescoping engagement with core section 30, having an inwardly tapered exterior surface 33 for engagement with a similarly tapered inside surface 34 on core section 30, and a central axially-aligned bore 65 for receiving the central hub portion of the upper core section 30.

When the two core sections are engaged, as shown in FIG. 2, an enclosed air space 36 of generally annular configuration is formed between the two core sections. As will be developed presently, this space results in a loading coil of improved efficiency, and hence an antenna of improved operating efficiency.

As described in the previously identified application Ser. No. 860,247, the bottom core section 31 includes a recess 37 which defines in conjunction with an electrically-conductive contact plate 38 a socket for receiving an antenna mounting pin 40. The mounting pin includes a plurality of radially-projecting electrically-conductive tabs 41 which simultaneously establish a bayonet-type twist-lock mechanical engagement with the antenna base 22 and an electrical connection between the antenna and an associated coaxial cable 42. In the direct mounting application shown, mounting pin 40 extends through an aperture 43 in mounting plate 24, and is drawn downwardly so as to urge base 22 and skirt 23 against the exterior surface of the mounting plate by means of a locking plate 44 disposed between the interior surface of the mounting plate and a rim portion 45 of increased diameter on the mounting pin. By turning an adjustment screw 46 carried on the locking plate the antenna base 22 and skirt 23 are securely mounted to plate 24.

The antenna base 22 is removed from skirt 23 by twisting the base in a counter-clockwise direction. The base remains mounted on panel 24 by reason of a locking plate 47 embedded in the skirt which engages a plurality of radially-projecting locking tabs 48 carried on the mounting pin. Should it be necessary to remove skirt 23, this can be accomplished by turning screw 46 to reduce the pull exerted by locking plate 44, and then twisting the skirt member 23 in a counter-clockwise direction with respect to the locking pin.

In a manner well known to the art, electrical tuning of radiating element 21 for a desired range of operating frequencies is provided by means of a base loading inductance winding 50 concentrically disposed over the upper core section 30. One end of winding 50 is electrically connected to a radially-projecting contact portion 51 of contact plate 38, and the other end of the winding is connected to an electrically-conductive end fitting 52 located along the axis of the antenna base adjacent the closed end portion of core section 30. The top end of end fitting 52 is preferably frusto-conical in form as shown to provide an aesthetically pleasing appearance, and the bottom end is preferably cylindrical in form as shown for engagement with an axially-aligned recess 53 of complimentary diameter in the upper core section 30. An axially-extending channel 54 may be provided in the bottom portion of end fitting 52 to receive the upper end of winding 50.

To provide a support surface for winding 50 an overmold layer 55 is provided over the exterior surface of the upper core section 30. For more positive alignment of the individual turns of the winding, this overmold layer 55 may include one or more axially-extending rib portions 56 wherein the individual turns of the winding are completely embedded such that movement of the turns is prevented. The overmold layer also serves to lock the electrically-conductive end fitting 52 in position by reason of an annular recess 57 provided between the upper and lower sections of the fitting within which the overmold layer extends. As shown in FIG. 2, the exterior surface of the overmold layer is preferably formed as an extension of the frusto-conical exterior surface of end fitting 52 to provide an aesthetically pleasing appearance for the antenna base. For the same purpose, a generally sleeve-shaped cover member 58 may be provided over the exterior surface of the overmold. A locking engagement may be provided for this cover member by means of annular rim portions 60 and 61 provided in the overmold layer.

In a manner well known to the art, the length of the radiating element 21 may be adjusted to provide for tuning the antenna for optimum efficiency for a particular range of operating frequencies and for a particular installation environment. To this end, radiating element 21 is slidably mounted within recess 32 such that its effective length can be varied by the user by adjusting the position of the element with respect to end fitting 52. Since that portion of the antenna below the end fitting does not function as a radiating element, to any significant degree, this has the effect of varying the radiating length of the element. Because of the relatively large diameter of winding 50 the effect of the non-radiating portion of element 21 being positioned within the winding is negligible. A locking screw 59 may be provided within a threaded recess 49 in the end cap to lock the radiating element in position.

As shown most clearly in FIGS. 4 and 5, the effect of core sections 30 and 31 being joined together is that an annular chamber 36 is formed between the sections. This space actually results from the combination of a recess 62 (FIG. 4) in the upper core section and recess 63 (FIG. 4) in the lower core section. An annular interior wall portion 64 may be provided on the bottom surface of the lower core section 31 to define a recess 65 in which the central axially-extending hub portion of the upper core section 30 is received.

The annular chamber 36 formed when the two core sections are combined in effect substitutes an air dielectric for the plastic dielectric material which would otherwise occupy the volume defined by the chamber, thereby improving the efficiency of the antenna loading coil. Since chamber 36 is completely enclosed by reason of the sealing engagement obtained between the upper and lower core sections 30 and 31, and the overmold layer 55 over the exterior surfaces thereof, water and other contaminants are prevented from entering the chamber.

For optimum efficiency it is desirable that winding 50 be of relatively large diameter. In one successful embodiment of the invention for use with a radiating element 57.25 inches long on the 27 $MH_z$ Citizen Band winding 50 is formed of seven turns of No. 12 gauge tin coated copper wire having a diameter of approximately 0.081 inch. The winding has a pitch diameter of approximately 1.625 inches and a length of approximately 2.25" inches. The outside diameter of the upper core section 30 is approximately 1.44 inches, and the overmold layer is approximately 0.185 inch thick. The isolation chamber 36 is approximately 1.00" in diameter and 1.00" in length.

Referring to FIG. 6, during manufacture of mobile antenna 20 the upper and lower core sections 30 and 31 are first separately formed by conventional injection-molding techniques. The two core sections are then joined together and winding 50, which is pre-wound as a substantially self-supporting structure, is inserted over the exterior surface of the upper core section 30. The upper end of winding 50 is preferably received in a channel 66 (FIG. 4) provided on the surface of the core section and attached by crimping or other appropriate means to the electrically-conductive end fitting 52. The other end of winding 50 is similarly attached to the terminal portion 51 of contact plate 38, which is preferably embedded in core section 31 concurrently with formation of that element. The resulting subassembly consisting of the combined core sections, winding 50 and end fitting 52 is then placed within the cavity formed by a two-piece mold 70. The surface of this cavity preferably includes a helical channel 71 within which winding 50 is positioned upon closure of the mold. With winding 50 thus aligned, plastic is injected into the mold to form overmold layer 55 between the exterior surface of the upper core section 30 and the surface of the mold cavity.

Figure 7:
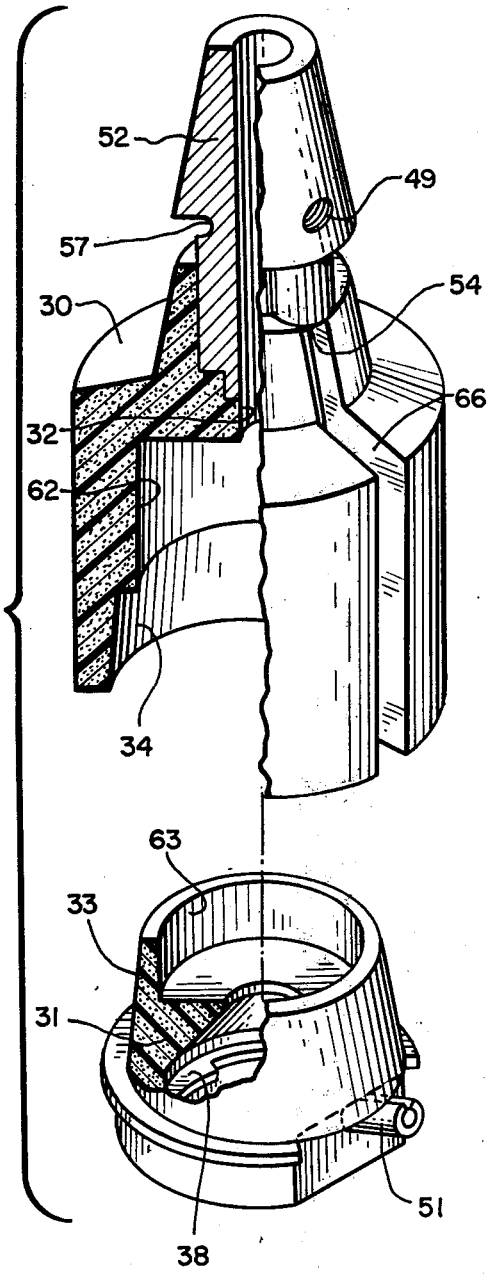
FIG. 7 is a view similar to FIG. 4 showing an alternative embodiment of the invention.
Figure 8:
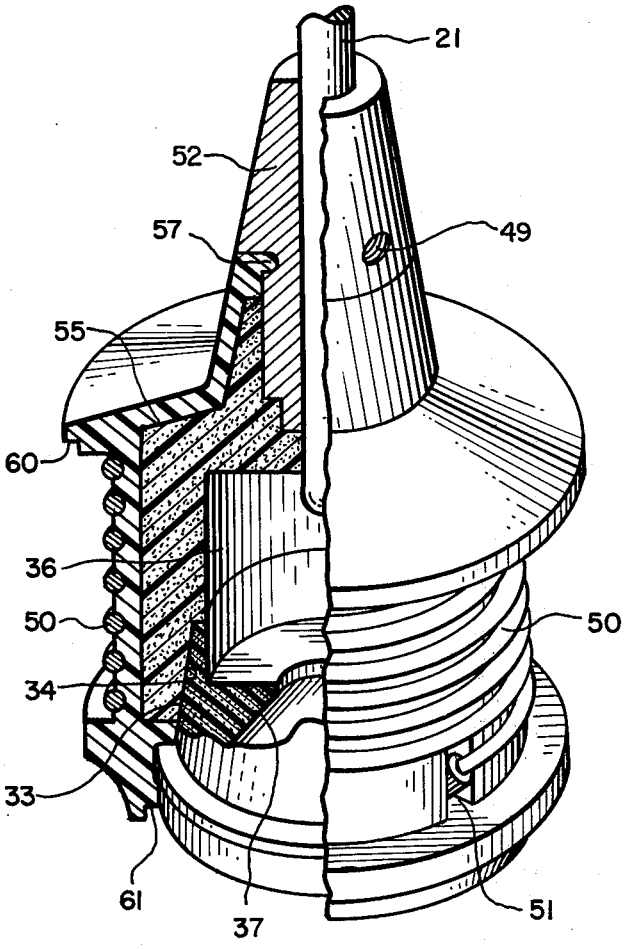
FIG. 8 is a view similar to FIG. 5 showing an alternative embodiment of the invention.

Referring to FIGS. 7 and 8, where isolation between interior chamber 36 and bore 32 is not deemed necessary, the central hub portion of the upper core section 30 can be eliminated. With this arrangement radiating element 21 extends into chamber 36 and is relied upon to prevent contaminants from entering the chamber through bore 32. With the exception of the elimination of the central hub portion of the upper core section, the antenna constructed in accordance with FIGS. 7 and 8 may be identical to that shown in FIGS. 1–6.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A mobile antenna operable from a source of radio frequency energy comprising, in combination:

an elongated radiating element;

an antenna base assembly for supporting said radiating element;

said base assembly including a core assembly comprising first and second core sections, said first core section being generally cylindrical with an first elongated axially-extending recess in one end thereof, and defining a generally cylindrical inductance winding support surface on the exterior surface thereof, said second core section being secured to said one end of said first section to close said first recess to define a closed interior chamber axially-disposed with respect to said winding support surface, and means including an inductance winding carried on said inductance winding support surface and electrically connected at one end to said radiating element, and connectable at its other end to the source of radio frequency energy, for conveying the radio energy to said radiating element an integral overmold layer formed on said winding support surface for supporting said inductance winding wherein said second core section defines an exterior locking surface, and said overmold layer extends over said exterior locking surface to maintain said first and second core sections in engagement.

2. A mobile antenna in accordance with claim 1 further comprising an end fitting carried by said core assembly for receiving said elongated radiating element, said end fitting including a locking surface over which said overmold layer extends to lock said end fitting in place.

3. A mobile antenna in accordance with claim 2 wherein said end fitting is electrically conductive and in electrical communication with said radiating element and said one end of said inductance winding.

4. A mobile antenna in accordance with claim 1 wherein said first recess is axially aligned with said radiating element, and said first core section includes an axially-aligned bore in the other end thereof and wherein one end of said radiating element is slidably received through said bore into said interior chamber.

5. A mobile antenna in accordance with claim 4 wherein said first core section further comprises an elongated interior hub portion within said interior chamber, said hub portion including said bore for receiving said one end of the radiating element.

6. A mobile antenna in accordance with claim 5 wherein said bore of said hub portion is closed at its interior end.

7. A mobile antenna in accordance with claim 1 wherein said second core section is telescopically received within said first core section, said second core section including a second recessed portion that is cooperatively associated with the recess in said first core section to define said interior chamber.

8. A mobile antenna in accordance with claim 4 wherein said first core section comprises a substantially cylindrical sidewall, an end wall and a center hub portion extending from said end wall interiorly of said sidewall and defining an annular space therebetween, said bore being located in said end wall and extending into said hub portion to receive said radiating element, said hub portion being closed at the end spaced from said end wall, said second core section comprising a pair of concentric sidewalls and an end wall together defining an annular recess therein, the outer of the concentric sidewalls, matingly engagable with the sidewall of said first section and the inner of the concentric sidewalls matingly engagable with the closed end of said hub portion.

9. A mobile antenna in accordance with claim 1 wherein said winding is received in helical grooves in said overmold layer, said overmold layer including rib portions at spaced circumferential locations to completely surround said winding.

10. A mobile antenna comprising, in combination:

an elongated radiating element;

an antenna base assembly for supporting said radiating element;

said base assembly comprising a support core assembly comprising first and second core sections defining an elongated chamber therewithin, said support core assembly including a substantially cylindrical sidewall and end walls;

an electrically conductive fitting carried on one end of said support core assembly and including a bore for receiving said radiating element;

an integral overmold layer around at least said sidewall and end walls to lock said first and second core sections together and cooperatively engaged with said fitting for securing it to said support core assembly;

means for electrically matching said antenna to a source of radio frequency energy including a helical inductance winding carried on said overmold layer with one end of said winding being in conductive relationship with said fitting, said winding residing in helical grooves in the surface of said overmold layer, said overmold layer including circumferentially spaced ribs surrounding said winding to hold it in place.

* * * * *